US006179508B1

(12) United States Patent
Coerver

(10) Patent No.: US 6,179,508 B1
(45) Date of Patent: Jan. 30, 2001

(54) RING BINDER

(75) Inventor: Charles B. Coerver, Imperial, MO (US)

(73) Assignee: U.S. Ring Binder Corporation, New Bedford, MA (US)

( * ) Notice: Under 35 U.S.C. 154(b), the term of this patent shall be extended for 0 days.

(21) Appl. No.: 09/468,275

(22) Filed: Dec. 20, 1999

(51) Int. Cl.[7] ..... B42F 3/00; B42D 3/00

(52) U.S. Cl. ..... 402/70; 402/80 R; 402/502; 402/73; 281/29; 281/37; 281/17; 281/19.1; 281/32

(58) Field of Search ..... 281/29, 36, 37, 281/17, 19.1, 32; 402/70, 73, 80 R, 502

(56) References Cited

U.S. PATENT DOCUMENTS

| | | | | |
|---|---|---|---|---|
| 831,969 | | 9/1906 | Morden et al. . | |
| 908,597 | | 1/1909 | Morden . | |
| 973,452 | | 10/1910 | Morden et al. . | |
| 973,932 | | 10/1910 | Fornoff et al. . | |
| 1,000,649 | | 8/1911 | Walker . | |
| 1,111,377 | | 9/1914 | Goss . | |
| 1,231,816 | | 7/1917 | Vesterling . | |
| 1,472,301 | | 10/1923 | Koepsell . | |
| 1,550,050 | * | 8/1925 | Schade . | |
| 1,556,721 | * | 10/1925 | Schade . | |
| 1,652,521 | | 12/1927 | Eifel . | |
| 1,761,589 | * | 6/1930 | Schade . | |
| 1,787,958 | * | 1/1931 | Shade . | |
| 2,073,049 | | 3/1937 | Dawson . | |
| 2,322,595 | | 6/1943 | Schade . | |
| 2,377,179 | * | 5/1945 | Pitt . | |
| 2,543,866 | | 3/1951 | Panfil . | |
| 2,831,706 | * | 4/1958 | Miller | 281/29 |
| 2,964,336 | * | 12/1960 | Akimoto | 281/29 |
| 3,074,744 | * | 1/1963 | Pucci et al. | 283/37 |
| 3,111,949 | * | 11/1963 | Duncan et al. . | |
| 3,132,649 | | 5/1964 | Gits . | |
| 3,253,603 | * | 5/1966 | Levitan . | |
| 3,262,454 | * | 7/1966 | Shillinger . | |
| 3,270,749 | | 9/1966 | O'Connell . | |
| 3,785,740 | | 1/1974 | Strong . | |
| 3,809,485 | * | 5/1974 | Beyer | 402/31 |
| 4,307,972 | * | 12/1981 | Errichiello | 402/73 |
| 4,314,716 | * | 2/1982 | Errichiello | 281/29 |
| 4,854,763 | | 8/1989 | Jonsson . | |
| 5,100,253 | * | 3/1992 | Cooper | 402/75 |
| 5,116,081 | | 5/1992 | Mann, Jr. . | |
| 5,158,386 | * | 10/1992 | Mann, Jr. | 402/41 |
| 5,203,590 | * | 4/1993 | Ranson | 281/29 |
| 5,340,071 | * | 8/1994 | Fox, II | 248/231.8 |
| 5,611,633 | | 3/1997 | Whaley . | |
| 5,622,386 | * | 4/1997 | Young | 281/36 |
| 5,692,847 | | 12/1997 | Zane et al. . | |
| 5,810,500 | * | 9/1998 | Whaley | 402/31 |
| 6,000,873 | * | 12/1999 | Burton | 402/75 |

* cited by examiner

*Primary Examiner*—Henry Tsai
*Assistant Examiner*—Alisa L. Thurston
(74) *Attorney, Agent, or Firm*—Polster, Lieder, Woodruff & Lucchesi, L.C.

(57) ABSTRACT

A ring binder (100) has a center spine (102) and end leafs (104). The spine section has jaws (108) formed on each side which extend the length of the spine section. Each end leaf has one end (104*a*) insertable into one of the jaws and thereafter held in place by serrations (110) forming the jaws and which frictionally engage the one end of the leaf to keep it permanently in place. A binder ring assembly (10) includes binder rings (18–22) and a mechanism (14,16) for opening and closing the rings. The spine section includes rivets (72) integrally formed at each end of the spine section and the binder ring assembly includes a cover (12) having corresponding openings (68*a*,68*b*) for attaching the binder ring assembly to the spine section. This binder construction allows different width end leafs to be used with a common spine section to form a variety of different size binders using a common spine section.

15 Claims, 7 Drawing Sheets

RING BINDER

CROSS-REFERENCE TO RELATED APPLICATIONS

None.

STATEMENT REGARDING FEDERALLY SPONSORED RESEARCH OR DEVELOPMENT

Not applicable.

BACKGROUND OF THE INVENTION

This invention relates to ring binders, and more particularly, to a ring binder having a spine section to which different end leafs are attachable so one spine section can be used to make a variety of binders.

Typically a ring binder includes a pair of end leafs the size of which correspond to the size of the sheets of paper held in the binder. The ring binder construction includes the end leafs and spine section to which a binder ring assembly is attached. The binder ring assembly usually includes two or more binder rings and a user operable mechanism for opening and closing the binder rings to store sheets of paper in the binder or remove them from the binder. Heretofore, it has been the practice to make the make the end leafs and spine section from a single piece of material, usually a cardboard material or a single sheet of a plastic. It would be advantageous, however, if it were possible to have a common spine section to which different size end leafs could be attached. It would be further advantageous if the spine section were so constructed that a binder ring assembly could be more easily attached to the binder than has been previously possible.

BRIEF SUMMARY OF THE INVENTION

Among the several objects of the present invention may be noted the provision of a ring binder;

- the provision of such a ring binder having a spine section commonly used with different end leafs so a variety of binders could be made using but a single spine construction;
- the provision of such a ring binder in which the spine section has opposed edges each of which is formed to receive and hold an end leaf of the binder, the end leaf being permanently held in place once installed;
- the provision of such a ring binder in which the spine section has an integrally formed means for attachment of a binder ring assembly to the binder; and,
- the provision of such a ring binder in which the end leafs are readily installed to the spine section and the spine section has edges constructed to receive and permanently hold the end leafs in place once attached thereto.

In accordance with the invention, generally stated, a ring binder includes a spine having integrally formed rivets at each end. A binder ring assembly is attached to the spine by snap fitting a cover piece of the assembly onto the rivets. The binder has two outer leafs which are attachable to opposite sides of the spine section to form a completed binder. Each leaf has an inner section of a first thickness and an outer section of a second and greater thickness. A shoulder is formed at the junction between the two sections. The inner section of each leaf fits into a jaws formed on each side of the spine section and extending the length of the spine section. Each set of jaws has serrations that grip the sides of a leaf section to frictionally engage the leaf and hold it permanently in place. Other means of permanently attaching the end leafs can also be used. The binder construction allows end leafs of different widths to be used with a common binder spine to form different size binders. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figures 1, 2:
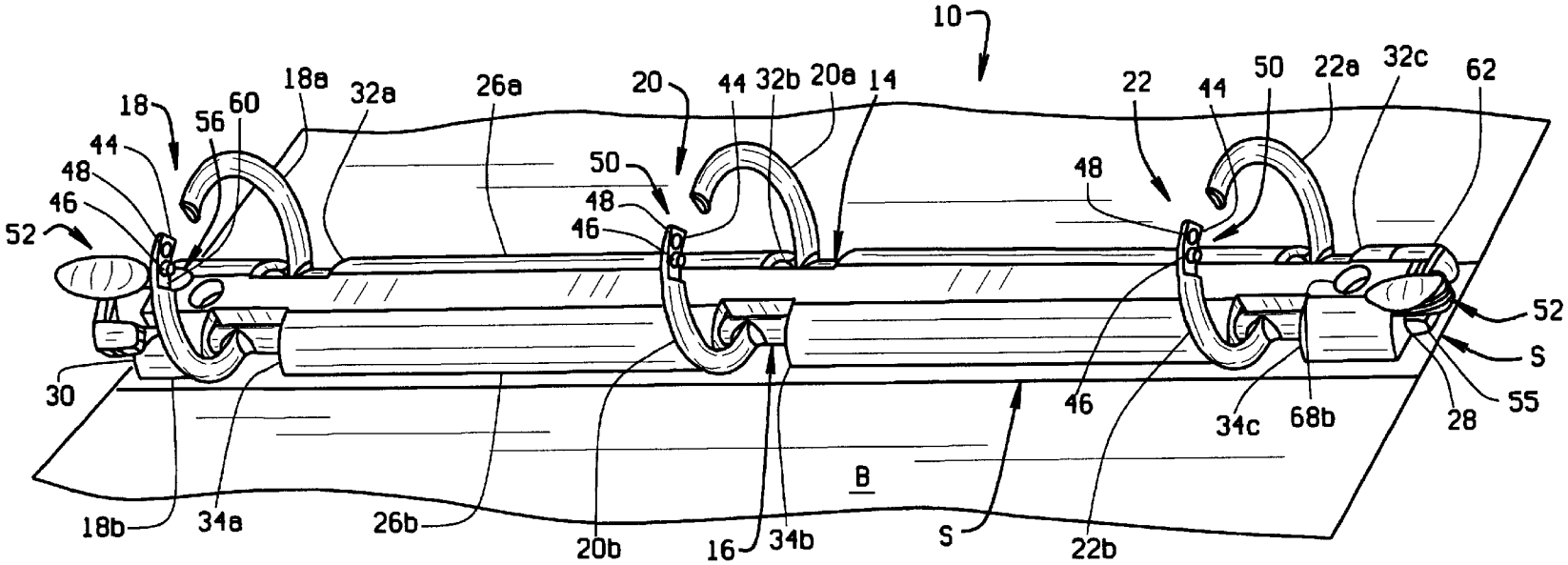
FIG. 1 is a perspective view of a bolt action ring assembly of the present invention, the ring metal being shown in its binder ring open position.
FIG. 2 is a top plan view of the assembly.
Figure 3A:
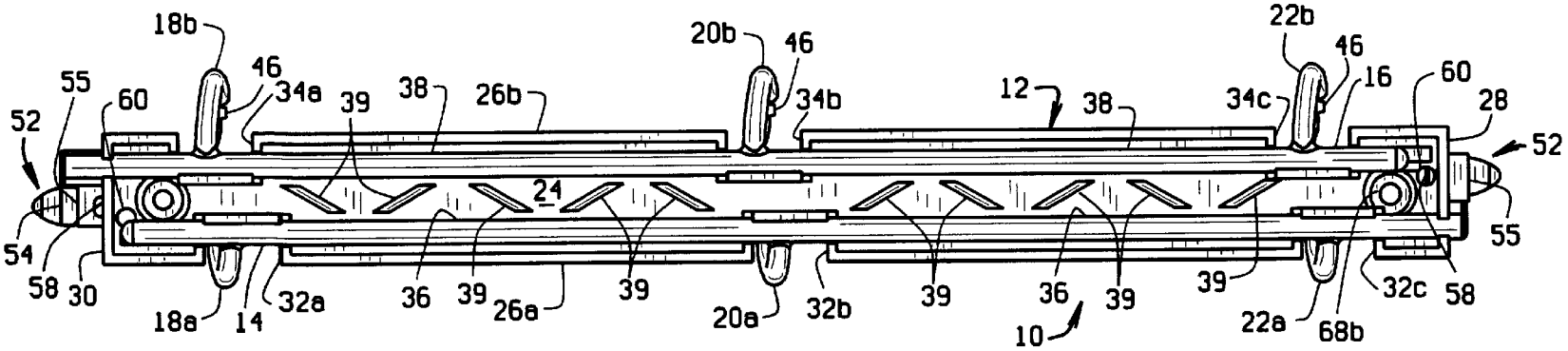
FIG. 3A is a bottom plan view of the assembly with the bolts on which ring sections are formed installed.
Figure 3B:
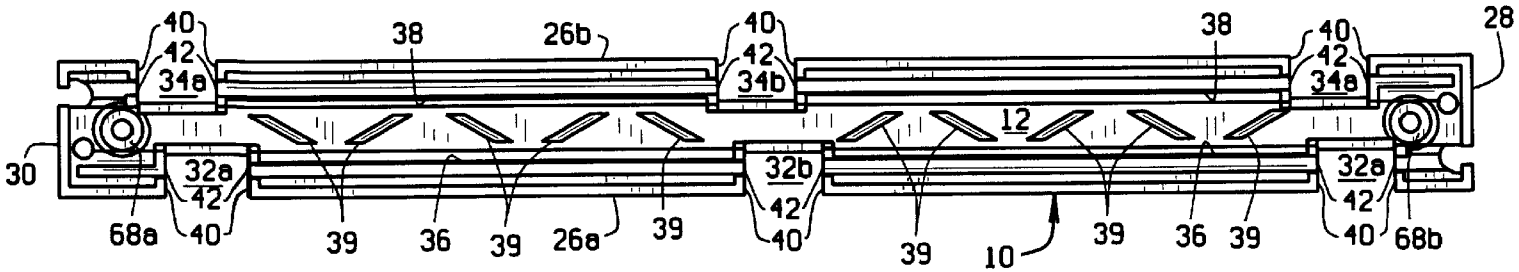
FIG. 3B is a similar view without the bolts installed.
Figure 4:
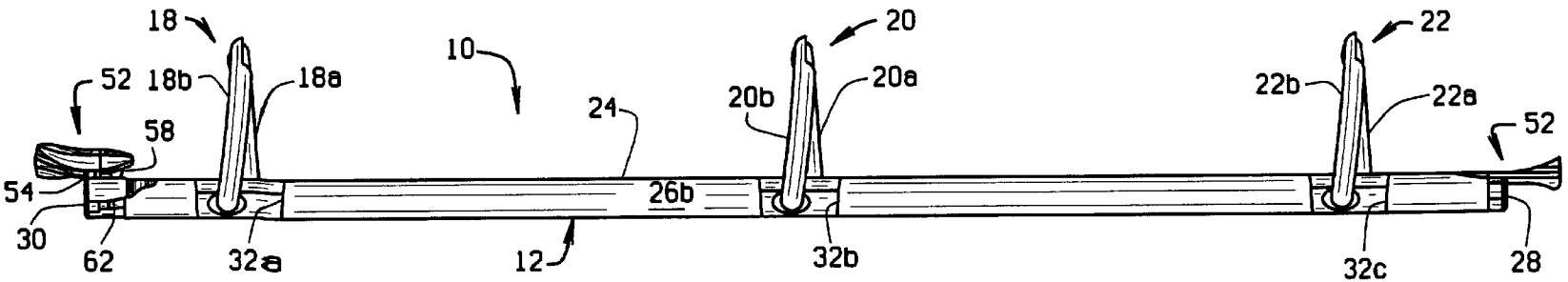
FIG. 4 is a side elevational view of the assembly.
Figure 5:
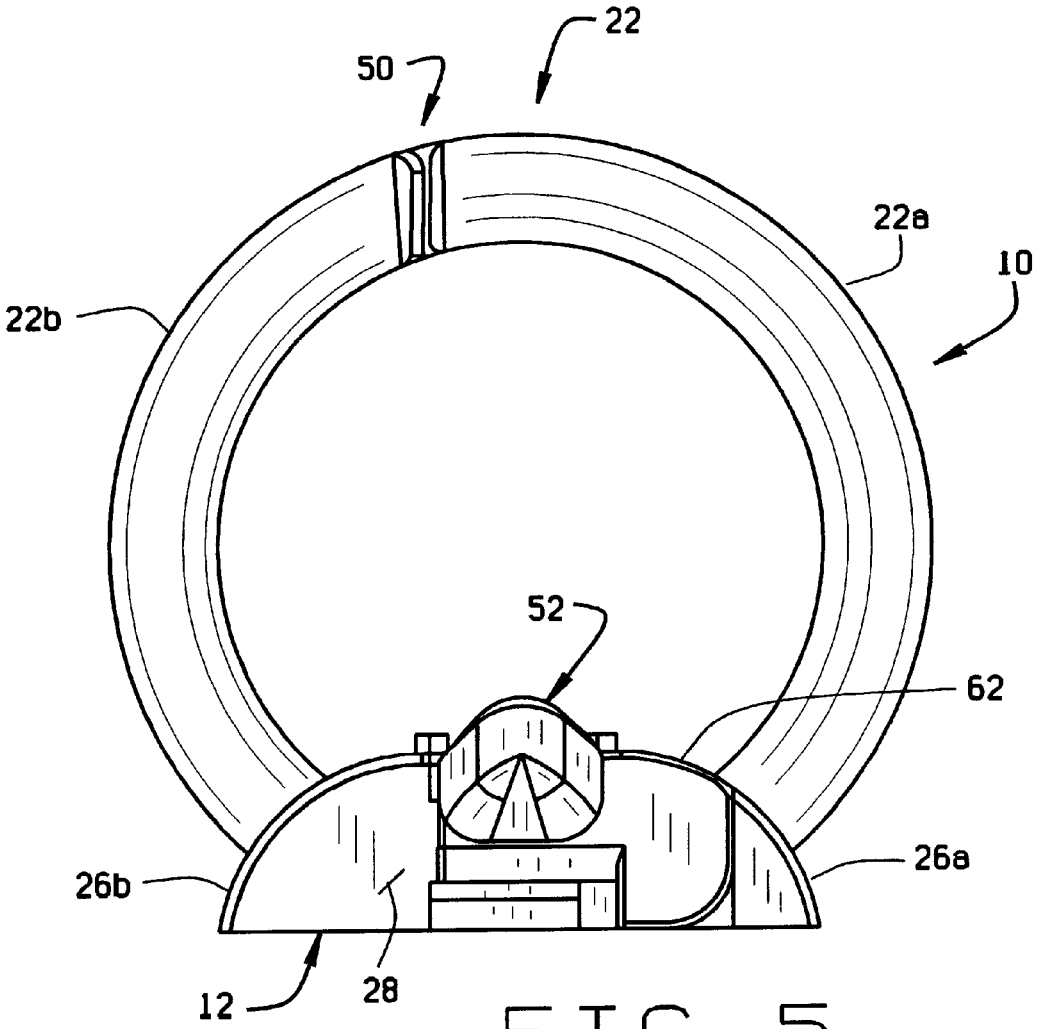
FIG. 5 is an end elevational view of the assembly.

Referring to the drawings, a bolt action ring binder assembly is indicated generally 10 and includes a cover piece 12 and bolts 14, 16 on which are integrally formed respective halves 18*a*–18*b*, 20*a*–20*b*, and 22*a*–22*b* of binder rings 18, 20, and 22. The cover plate and bolts are each preferably formed of a lightweight, yet strong plastic material. Preferably the cover piece is made of a copolymer material such as polypropolene, and the bolts of an acetal. This not only keeps the weight of assembly 10 to a minimum, but also allows the binder to hold a substantial quantity of paper without inadvertently opening. As shown in FIGS. 3A and 3B, cover plate 12 is shown to be of a molded construction; while, in FIGS. 6–8, the bolts 14, 16 and the respective ring halves are similarly shown to be of a single-piece molded construction.

Cover plate 12 has a flat central section 24 which extends longitudinally of the assembly the length of the cover plate.

On both sides of this central section respective curved sidewalls 26*a*, 26*b* are formed. An endwall 28, 30 is formed at each end of the plate. A series of recesses are formed in each sidewall, recesses 32*a*, 32*b*, 32*c* in sidewall 26*a*, and recesses 34*a*, 34*b*, 34*c* in sidewall 26*b*. As shown in FIGS. 3A and 3B, respective channels 36, 38 are formed on the underside of cover 12, each channel extending horizontally of the cover plate, substantially the length of the plate. These Each channel is formed in the underside of one of the plate sidewalls and is sized to receive one of the bolts 14, 16 and facilitate reciprocal movement of the bolts both longitudinally of the cover plate, as well as rotary movement of the bolt. The bolts 14, 16 are circular in cross-section. Channels 36, 38 are generally semi-circular in shape and the diameter of the channels corresponds to the diameter of the bolts for the bolts to slidingly and rotatingly received in the channels. Reinforcing ribs 39 are formed between the channels to strengthen the cover piece. As shown in FIGS. 3A and 3B, these ribs extend the length of the cover. As further shown in FIG. 3B, each recess in the respective sidewalls of the cover plate has end walls 40 at each end in which are formed openings 42 sized for the bolts, when installed, to move freely back and forth as a rotationally. This allows the bolts to be moved relative to each other; first longitudinally to move the respective halves forming a binder ring to move away from each other, and then for one of the bolts to be rotated so that one ring half is rotated away from the other a distance sufficient to readily allow the pieces of paper to be stored in, or removed from, the binder in which the assembly is installed.

Figure 8:
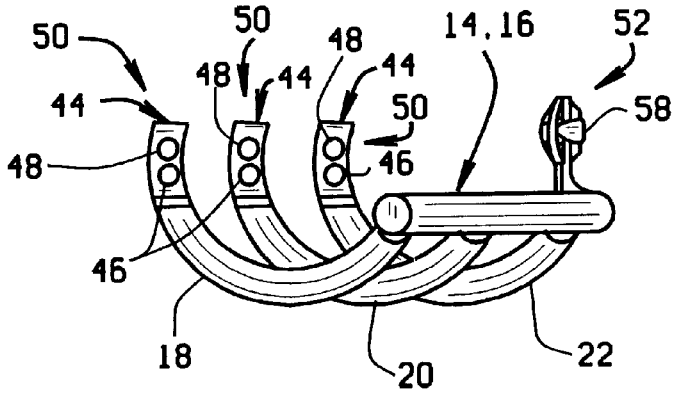
FIG. 8 is a perspective view of the bolt.
Figure 6:
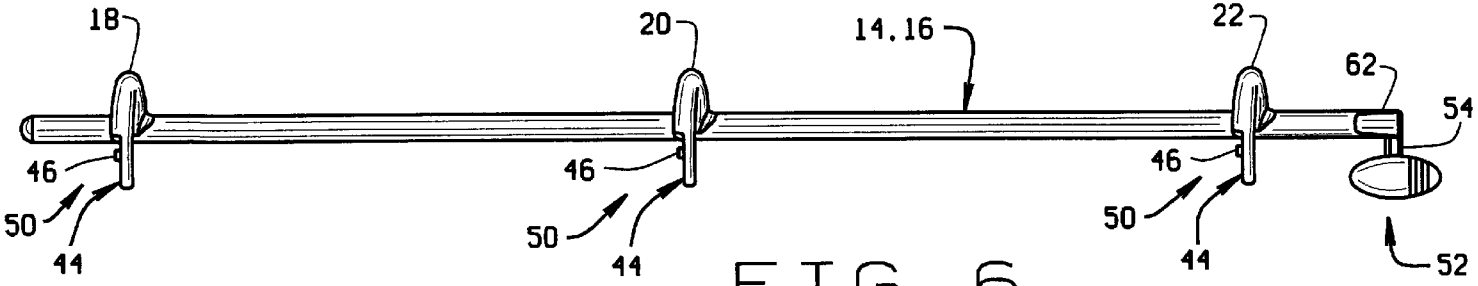
FIG. 6 is a top plan view of a bolt installed in the assembly.
Figure 7:
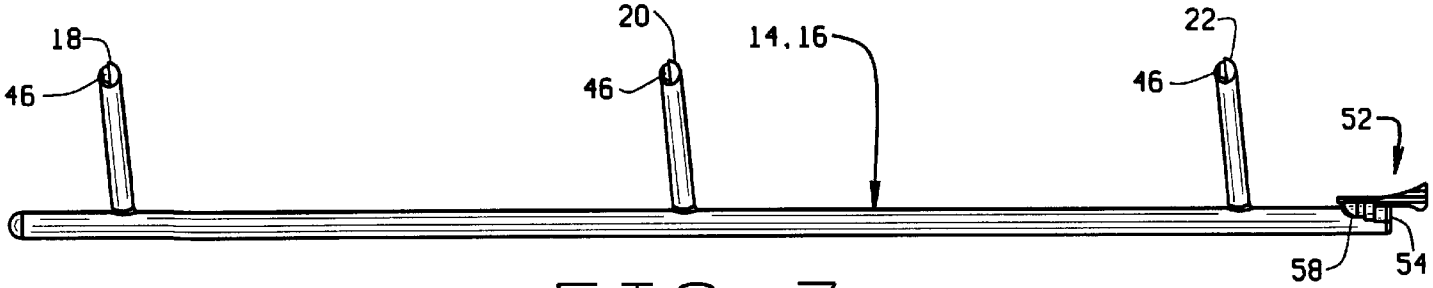
FIG. 7 is a side elevational view of the bolt.

Referring to FIGS. 6–8, each bolt 14, 16 has, as noted, one half of a binder ring formed it. Each binder ring half matingly latches with a binder ring half formed on the other bolt. As shown in the drawings, the binder ring assembly has three binder rings and so there are three binder ring halves integrally formed with each bolt. The ring halves are spaced along the length of each bolt so that there is one ring formed generally at each end of the assembly, as well as in the middle thereof. Further, the ring halves are not formed of straight segments, but rather the ring halves are curved along their length. This is to facilitate latching and unlatching of the respective halves to close and open the rings. Further, as best shown in FIGS. 3A and 3B, the recesses formed the respective sidewalls of cover 12 do not align with each other, but rather are offset. In each instance, the amount of offset is uniform from set of opposed recesses to the other, and all of the recesses are offset in the same direction. Referring to FIG. 6, at the distal end of each ring half, there is a flattened section indicated generally 44. Toward the inner end of each flattened section there is formed a circular pin 46, and at the outer end of the section is formed a circular recess 48 whose diameter corresponds to that of the pin and whose depth corresponds to the height of the pin. The pins and recesses together form a latching means 50 by which the respective ring halves interlock with each other to close the binder rings. The respective bolts 14,16 are identically formed and thus are interchangeable with each other. Further, the construction of the cover is such that the bolts move in opposite directions to each other; although, it will be understood by those skilled in the art, that only one bolt has to be moved in order to unlatch and open the binder rings and latch and close them.

Figure 9:
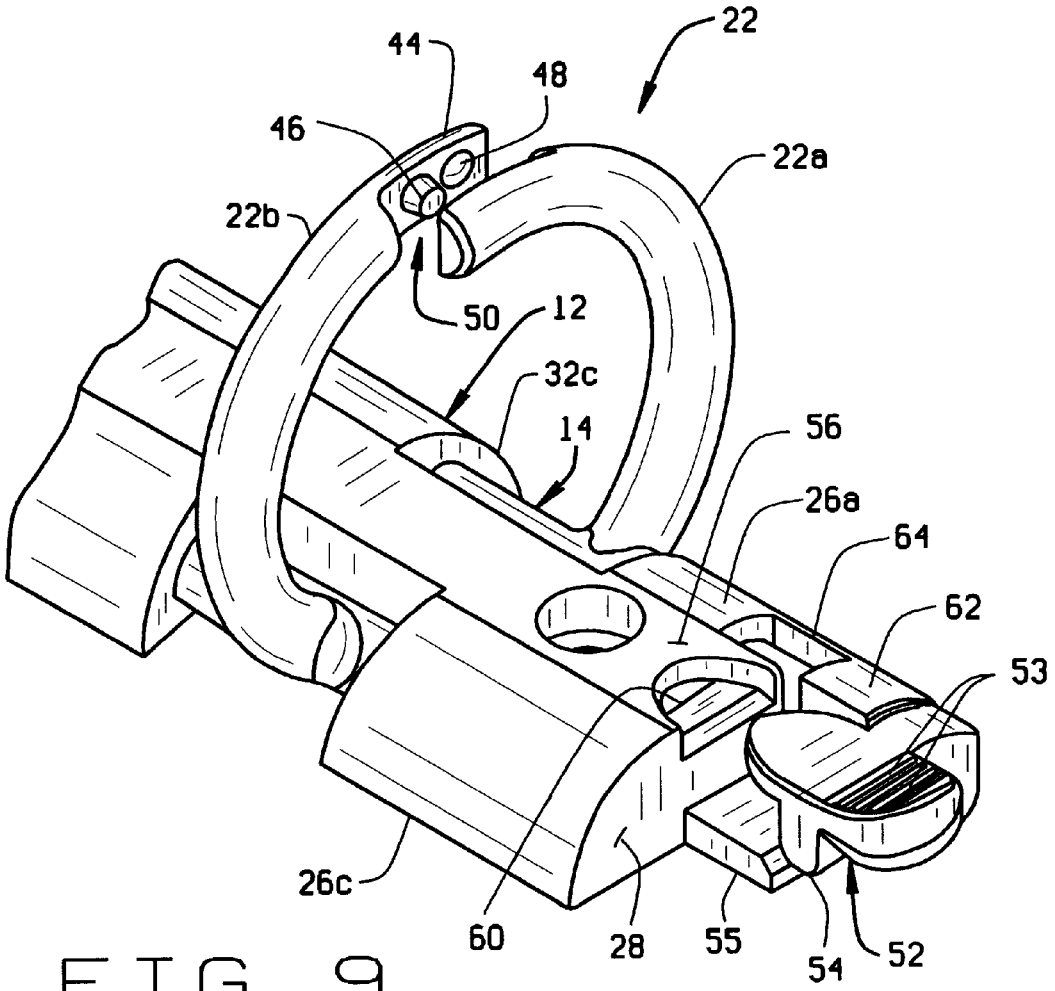
FIG. 9 is a perspective view of one end of the cover plate illustrating a thumb pad release and guide finger portion of the assembly.
Figure 10:
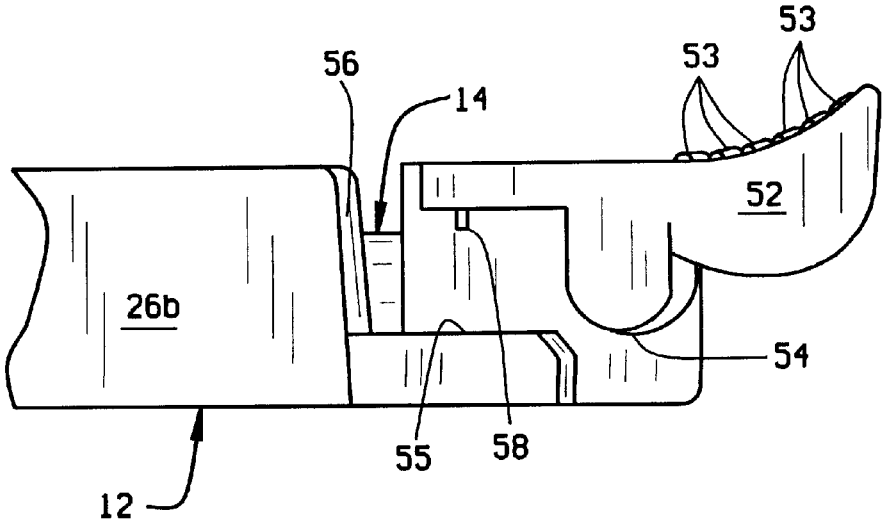
FIG. 10 is an elevational view of the end of the assembly shown in FIG. 9, better illustrating the thumb pad release.

At one end of each bolt there is formed a thumb operated release indicated generally 52 by which a bolt can be locked in place and prevented from inadvertently being moved. As shown in FIGS. 6, 8, 9 and 10, release 52 is a thumb pad integrally formed with the bolt. The release has a generally oval shape, when viewed in plan, and as shown in FIG. 10, the outer end of the release is greater in height then the inner end thereof. The upper surface of the release is contoured to generally conform to the shape of a person's thumb pad and the outer end of the upper surface includes a series of ridges 53 extending orthogonally of the pad to facilitate gripping of the pad. This makes it easy for the person to actuate the bolt by pressing on the release. An ear 54 depends from the underside of the release. A shelf 55 extends rearwardly of end 28 of the cover piece and the bottom of the ear rides upon an upper surface of the shelf as the release is moved back and forth with the bolt 14,16.

A recess 56 is formed at each end of cover 12. The recess has a shape conforming to that of the inner end of release 52 for this end of the release to fit in the recess. Each recess is formed in the flat surface section 24 of the cover. A pin 58 is formed on the underside of release 52, and a cavity 60 is formed in the base of recess 56 at the inner end of the recess. Pin 58 fits in this recess to capture and hold the release in place. In operation, the user presses down on the back of release 52 which rotates the front end of the release upward freeing pin 58 from cavity 60. In will be appreciated that this action only releases the bolt to be moved. This action, in and of itself, does not move the bolt are cause either rotationally or longitudinally, so the binder rings remain closed. The bolt is now, however, freely movable by the user to open and close the binder. When the binder rings are closed and interlocked, release 52 is positioned above recess 56. By pressing down on the front end of the release with their thumb, the user pushes pin 58 into opening 60 to lock the bolt in place.

Also integrally formed with bolt 14, 16 is a guide finger 62. The finger is formed at the same end of the bolt as release 52 and extends longitudinally of the bolt, above the bolt. As best shown in FIG. 9, a slot 64 is formed in the each end of cover plate 12 on the other side of the cover piece from recess 56. The slot is a longitudinally extending slot and is sized and shaped for the guide finger to be received in the slot when the user moves the bolt in the direction to close the binder rings. Guide finger 62 is an alignment feature to facilitate latching of the binder ring halves when the rings are to be closed. That is, when the user wants to close the rings, he rotates a bolt to its position where guide finger 62 is aligned with slot 64. Now, longitudinal movement of the bolt inserts the guide finger in the slot. At the same time, the latching pins 46 on the binder ring halves formed on the bolt should insert into the holes 48 in their companion ring halves formed on the other bolt because alignment of the fingers with respective pockets simultaneously, and automatically, aligns the latching means on the binder rings.

Figure 11:
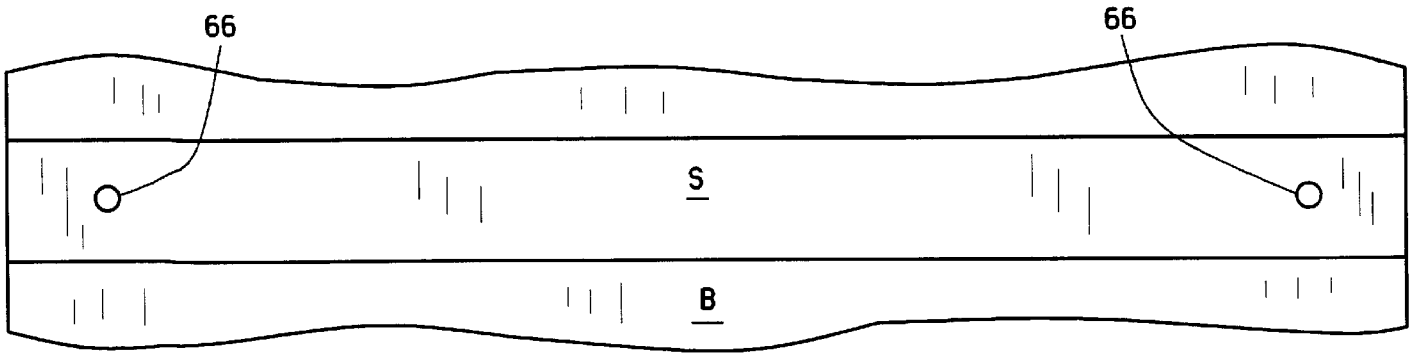
FIG. 11 is a plan view of a spine portion of the binder to which the binder ring assembly is attached.
Figure 12:
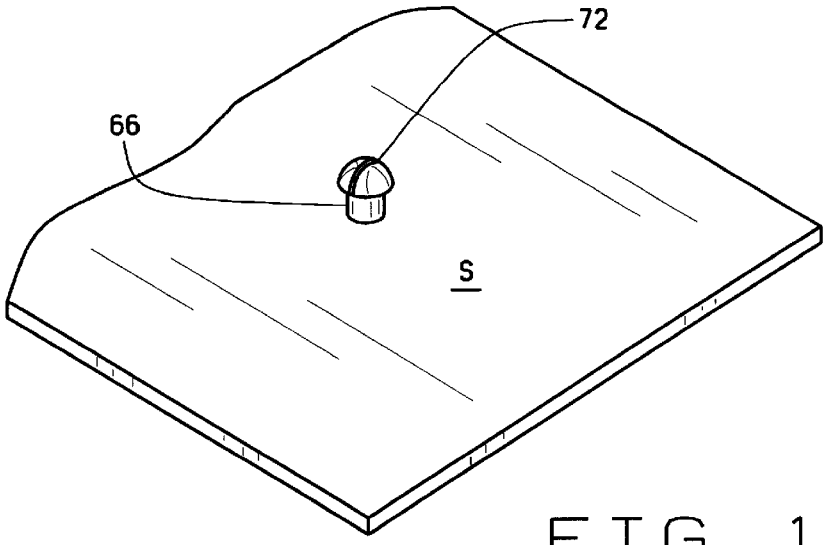
FIG. 12 is perspective view of a portion of a binder spine on which a rivet for attaching the binder ring assembly to the spine is integrally formed.

Binder ring assembly 10 is fastened to the spine S of a binder B in a number of ways. As shown in FIG. 11, a pair of fasteners such as rivets 66 are used to attach the assembly to the spine of the binder. Holes 68*a*, 68*b* are formed at respective ends of the cover plate. The fasteners are each attach to the cover through these holes with the other end of the fasteners attaching to the binder spine. Alternatively, and as shown in FIG. 12, if the binder is also made of a plastic, the rivets can be integrally formed with the binder spine. Now, the assembly is attached by "snap fitting" it in place. That is, the cover plate is pressed down onto the heads 72 of the rivets which are forced through the openings 68. When the rivet heads clear the openings, the assembly is fitted in place.

Figure 13:
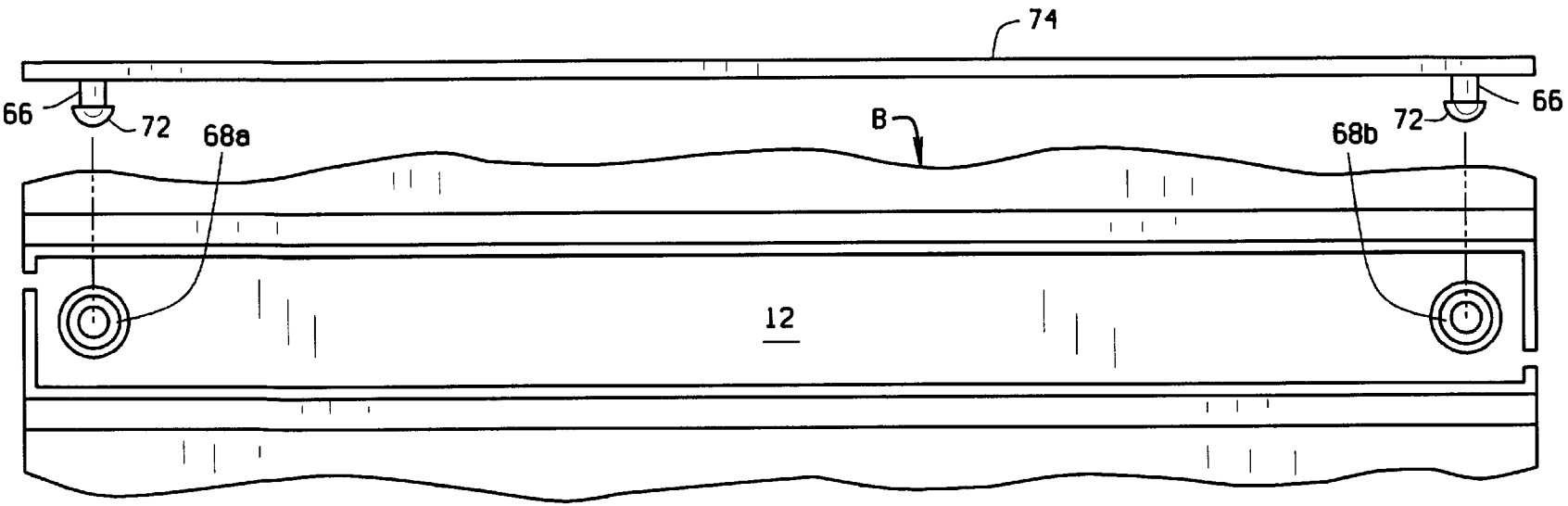
FIG. 13 is a bottom plan view of an alternate spine construction in which the cover piece of the assembly is integrally formed as part of the spine with a cover piece which is installed over the bottom of the binder ring assembly.

Another binder construction is shown in FIG. 13. In this embodiment, the cover plate 12 for the binder ring assembly is integrally formed as part of the binder spine. For clarity in FIG. 13, only a simplified plan view of the underside of the cover is shown. Now, after the bolts 14, 16 are mounted in place, a backing plate 74 including integrally formed rivets 66 is installed to the exposed backside of the cover. As before heads 72 on the rivets are inserted into holes 68*a*, 68*b* formed in the cover. When the backing plate is "snap fitted" in place, it covers the outside of the binder spine forming a completed binder assembly.

Figure 14:
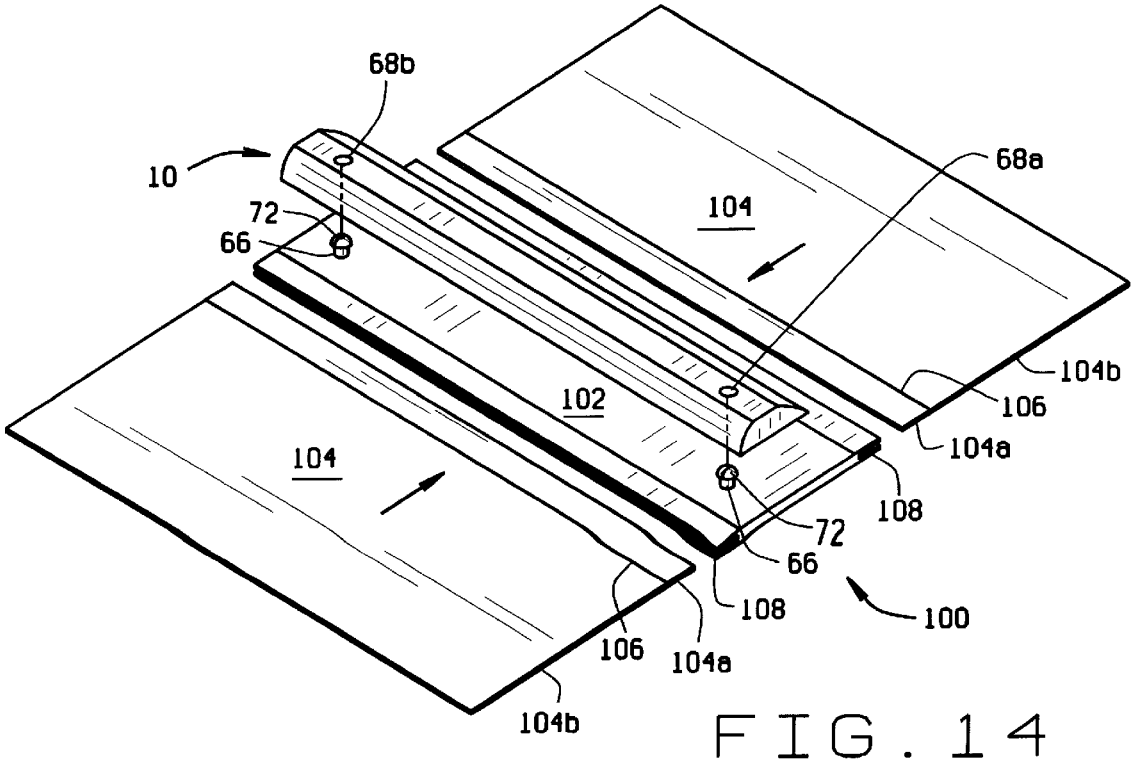
FIG. 14 is a perspective view of a modular ring binder with which the binder ring assembly is used; and, FIG. 15 is an end elevational view of the modular ring binder illustrating installation of leaf members to a spine portion of the binder.
Figure 15:
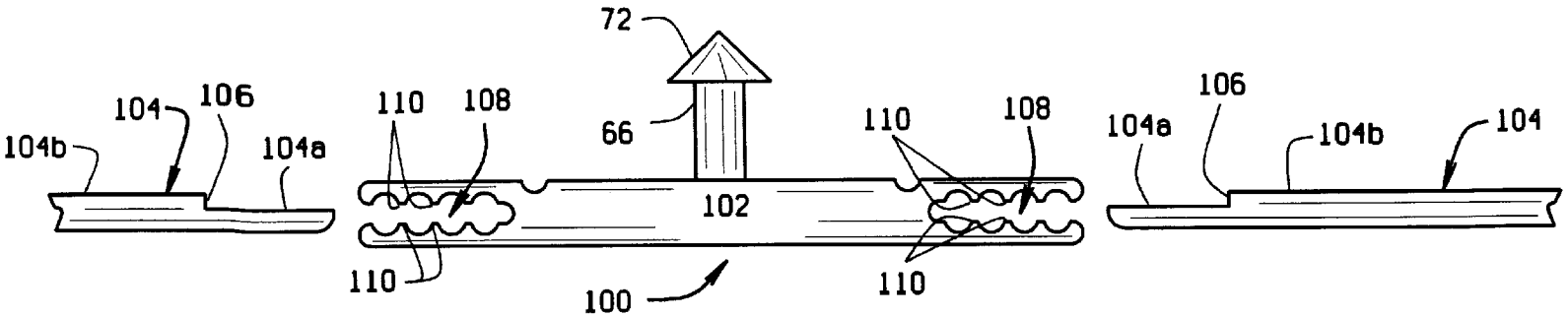

Finally, referring to FIGS. 14 and 15, a binder 100 includes a spine 102 including the rivets 66 at each end. As shown in FIG. 14, assembly 10 is attachable to the spine in the manner previously described. The binder has an outer leaf 104 which is made of plastic material and two such leafs are attachable to opposite side of spine 102 to form a completed binder. Each leaf 104 has an inner section 104*a* of a first thickness, and an outer section 104*b* of a second and greater thickness. A shoulder 106 is formed at the junction between the two sections. As shown in FIG. 15, the thinner section 104*a* of each leaf fits into a jaws 108 formed on each side of spine 102 and extending the length of the spine section (see FIG. 14). Section 104*a* of a leaf is inserted into the jaws section of spine 102, the entire width of the section up to the shoulder 106 being fitted into the jaws. Each set of jaws includes serrations 110 which grip the sides of leaf section 104*a* to frictionally engage the leaf and keep it permanently in place. Each jaws is comprised of a plurality of serrations 110, four such serrations being shown for each jaw in FIG. 15. The serrations extend parallel to each other and extend the entire length of the spine section. Alternately, the leafs can be permanently secured to the spine by gluing the two pieces together, press fitting them together, or heating them to create a bond between them. An advantage of the binder construction shown in FIGS. 14 and 15 is that the spine can be used with a wide variety of leafs. That is, different widths of leafs can be used with a common spine to form different size binders.

What has been described is a ring binder having a spine section commonly used with different end leafs so a variety of binders can be made using a single spine construction. The spine section has opposed edges each of which includes jaws formed to receive and permanently hold an end leaf of the binder. The spine section also has rivets integrally formed at each end of the section for attaching a binder ring assembly to the binder. The end leafs and binder ring assembly are readily and permanently installed to the spine section to simplify binder manufacture.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A ring binder comprising:

a spine section; and, a pair of outer leafs attachable to the spine section, the spine section having jaws formed on each side thereof and extending the length of the spine section, and each outer leaf having one end insertable into one of the jaws to be thereafter held in place by serrations forming the jaws which serrations frictionally engage the one end of the outer leaf to keep it permanently in place whereby different width outer leafs can be used with a common spine section to form a variety of different size binders using a common spine section.

2. The ring binder of claim 1 wherein each outer leaf has an inner section of a first thickness and an outer section of a second and greater thickness, the inner section of each outer leaf being insertable into a respective jaws of the spine section.

3. The ring binder of claim 2 wherein each jaws is comprised of a plurality of serrations which extend parallel to each other and extend the entire length of the spine section.

4. The ring binder of claim 3 wherein a shoulder is formed at the junction between the inner and outer sections of each outer leaf and the inner section of each outer leaf being inserted into one of the jaws until the shoulder abuts the side of the spine section.

5. The ring binder of claim 1 further including a binder ring assembly including at least binder ring and a mechanism for opening and closing the binder ring.

6. The ring binder of claim 5 wherein the spine section includes means for securing the binder ring assembly to the spine section.

7. The ring binder of claim 6 wherein the spine section includes a rivet integrally formed at each end of the spine section and the binder ring assembly includes a cover having corresponding openings for the binder ring assembly to attach to the spine section.

8. The ring binder of claim 1 wherein the spine section and outer leafs are each formed of a plastic material.

9. A ring binder comprising:

a spine section having opposed edges and a jaw formed in each of said edges, said jaws extending the length of said edges and having an upper part and a lower part, said upper part and said lower part having facing surfaces and serrations formed in said jaw facing surfaces; and, a pair of one-piece outer leafs attachable to the spine section, each outer leaf having a substantially flat end insertable into one of the jaws, the jaw serrations engaging said outer leaf to frictionally engage the one end of the outer leaf to keep it permanently in place whereby different width outer leafs can be used with a common spine to form a variety of different size binders using a common spine section.

10. The ring binder of claim 9 wherein each outer leaf has an inner section of a first thickness and an outer section of a second and greater thickness, the inner section of each outer leaf being insertable into a respective jaws of the spine section.

11. The ring binder of claim 10 wherein a shoulder is formed at the junction between the inner and outer sections of each outer leaf and the inner section of each outer leaf being inserted into one of the jaws until the shoulder abuts the side of the spine section.

12. The ring binder of claim 9 further including a binder ring assembly including at least binder ring and a mechanism for opening and closing the binder ring.

13. The ring binder of claim 12 wherein the spine section includes means for securing the binder ring assembly to the spine section.

14. The ring binder of claim 13 wherein the spine section includes a rivet integrally formed at each end of the spine section, and the binder ring assembly includes a cover having corresponding openings for the binder ring assembly to attach to the spine section.

15. The ring binder of claim 9 wherein the spine section and outer leafs are each formed of a plastic material.

* * * * *